United States Patent [19]

Gogniat

[11] Patent Number: 5,077,710

[45] **Date of Patent: * Dec. 31, 1991**

[54] WATCHCASE HAVING CASEBAND FASHIONED FROM A CONTOURED STRIP

[75] Inventor: Paul Gogniat, Bienne, Switzerland

[73] Assignee: Eta Sa Fabriques d'Ebauches, Granges, Switzerland

[ * ] Notice: The portion of the term of this patent subsequent to Jul. 24, 2007 has been disclaimed.

[21] Appl. No.: 494,800

[22] Filed: Mar. 13, 1990

Related U.S. Application Data

[62] Division of Ser. No. 287,437, Dec. 21, 1988, abandoned.

[30] Foreign Application Priority Data

Dec. 23, 1987 [CH] Switzerland ..... 05010/87

[51] Int. Cl.[5] ..... B22P 13/00; G04B 32/00

[52] U.S. Cl. ..... 368/288; 368/281; 368/276; 72/254; 29/179

[58] Field of Search ..... 368/276, 280, 281, 282, 368/294–296, 360; 72/254; 29/177, 179, 417, DIG. 15

[56] References Cited

U.S. PATENT DOCUMENTS

| | | | |
|---|---|---|---|
| 2,020,740 | 11/1935 | Putnam | 368/294 |
| 2,695,105 | 11/1953 | Halbig et al. | 368/296 |
| 3,030,698 | 4/1962 | Pissarevsky | 368/295 |
| 4,236,239 | 11/1980 | Imgruth et al. | 368/72 |
| 4,396,298 | 8/1983 | Ripley | 368/282 |
| 4,473,306 | 0/1984 | Leddery | 368/285 |
| 4,674,892 | 6/1987 | Loth | 368/280 |
| 4,740,935 | 4/1988 | Gogniat | 368/292 |
| 4,942,755 | 7/1990 | Gogniat | 368/280 |

FOREIGN PATENT DOCUMENTS

| | | | |
|---|---|---|---|
| 105841 | 4/1984 | European Pat. Off. . | |
| 294198 | 11/1915 | Fed. Rep. of Germany | 368/296 |
| 2329002 | 5/1977 | France . | |
| 294064 | 1/1954 | Switzerland . | |
| 0313607 | 4/1956 | Switzerland | 368/296 |
| 0337466 | 3/1959 | Switzerland | 368/296 |
| 346177 | 6/1960 | Switzerland . | |
| 354034 | 4/1981 | Switzerland . | |
| 887130 | 3/1960 | United Kingdom . | |
| 8604696 | 8/1986 | World Int. Prop. O. . | |

OTHER PUBLICATIONS

Schmuck & Uhren, No. 9, Sep. 1984, p. 5, Ulm DE; "Die Zeit Hat Ein Neues Gesiht"–No Translation.

*Primary Examiner*—Bernard Roskoski

*Attorney, Agent, or Firm*—Griffin, Branigan & Butler

[57] ABSTRACT

The caseband (1) of this invention is fashioned from a contoured strip (2) which includes a profile in relief elongated in the longitudinal direction of the strip. This profile may serve a purely decorative purpose but may also have functional applications for instance that of attaching a watch crystal to the caseband. In such case the profile in relief includes projections (3) which define facing slide channels (6) into which the crystal may be introduced.

8 Claims, 4 Drawing Sheets

WATCHCASE HAVING CASEBAND FASHIONED FROM A CONTOURED STRIP

This invention concerns a case for a wristwatch including a caseband removed from a portion of a contoured strip.

BACKGROUND OF THE INVENTION

It has already been suggested to provide a caseband for a wristwatch case formed from a contoured strip. Swiss patent document CH-A-492 244 describes a mass production method of manufacturing watch cases from a contoured strip having a rectangular cross-section. In this method one begins by piercing pilot holes in the strip, such holes providing means for driving and centering for all subsequent operations. Next a cap is formed by cold pressing by means of a die and punch, such cap forming the case of the watch. Attachment lugs are struck out by punching, the crystal snap is machined by turning, one proceeds to arching of the lugs, then the holes necessary to accommodate the winding stem and the bracelet attaching bars are pierced. Finally, the case is separated from the strip. The entire process is brought about by an installation permitting a step by step advance of the strip and positioning thereof at each work station.

The watch case thus obtained has however several disadvantages. Initially, it may be said to show a mediocre aspect since the case and in particular the bezel which surrounds the crystal are obtained from a flat strip having no particular decoration. Next there is the disadvantage of requiring costly retouching operations if only for fastening the crystal and/or the case back, if a removable case back is considered indispensable for access to the watch mechanism. Finally, there is the disadvantage of requiring the employment of attachment bars for the bracelet at least in the embodiment as proposed.

It has also been suggested to mass produce a case band from a contoured strip extruded in the form of a tube. British patent document GB-A-887 130 shows such an arrangement where, after having attached lugs by welding along the tube, such tube is cut into slices to obtain the desired caseband. This system is relatively expensive to put into practice and above all does not permit obtaining directly from the contour a structure in relief elongated in the sense in which the contour is drawn, since the contour of the cited document comprises a tube and not a strip as in the present invention.

French patent document FR-A-2 329 002 describes a watchcase including a bezel formed from folded sheet metal including two attaching ridges thanks to which may be assembled a crystal and a back cover-container. Herein there is found no structure in relief which could be obtained from a contoured profile as is the case in the present invention.

SUMMARY OF THE INVENTION

Thus, to overcome the cited difficulties, the case band in accordance with this invention is characterized in that it exhibits a profile in relief originating in the strip and elongated in the longitudinal direction thereof. The invention extends likewise to a contoured strip for the manufacture of casebands of watchcases as well as to a method for the mass production of such case bands.

Thus, one of the purposes of the invention is to provide a caseband for watchcases which is obtained from a portion of a contoured strip having a structure in relief employed as decoration for said caseband.

Another purpose of the invention is to employ such profile in relief as a means for fastening to the caseband various elements forming part of the watch as for instance the watch crystal and/or the back cover.

Another purpose of the invention is to employ said profile in relief to serve as bracelet attachment.

Another purpose of the invention is to employ said profile in relief to serve as means for fastening to the caseband decorative or functional inserts such latter enabling for instance to fasten the crystal to the caseband.

The invention will be better understood from reading of the description to follow of the several embodiments given by way of non-limiting examples and illustrated in the drawings.

DESCRIPTION OF THE PREFERRED EMBODIMENT

Figure 1:
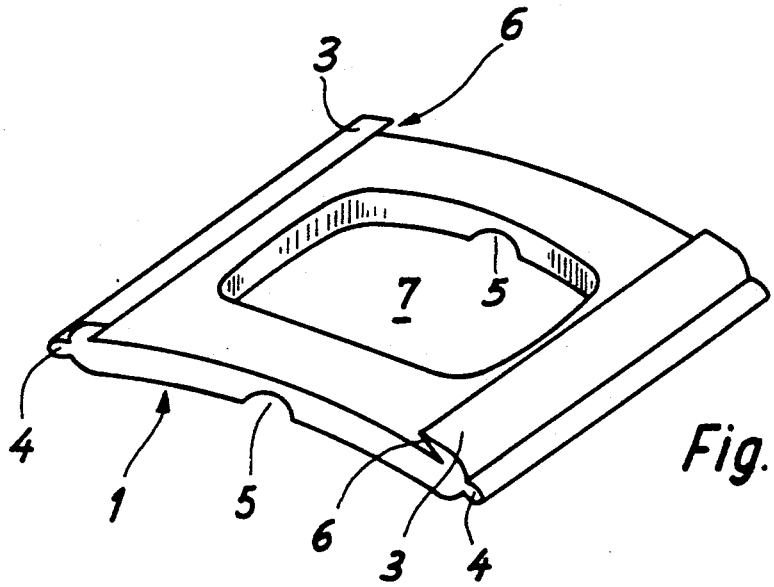
FIG. 1 shows on a reduced scale a caseband for a watchcase according to a first embodiment of the invention in which the strip is contoured to receive a crystal as well as a bracelet attaching system.

The caseband 1 shown on FIG. 1 exhibits a first embodiment of the invention. This caseband is obtained from a contoured strip shown to a reduced scale on FIG. 2. Essentially and in accordance with the invention, the caseband includes a profile in relief which is obtained from the strip 2 and which is elongated in the longitudinal direction of said strip. By relief here is understood the form of a surface which includes projections and/or hollows. In the example of FIG. 1 there are found projections at the portions referenced 3 and 4 which serve as means for fastening elements to the caseband which form part of the watch. Here the projections 3 define slide channels 6 which face one another and into which a crystal (not shown) may be introduced. In the same manner projections 4 are elongated beads which each serve as an attachment for a half-bracelet (not shown). On FIG. 1 may also be found recesses referenced 5 and 6, the recesses 5 being arranged for instance to enable passage of a winding stem and recesses 6 forming the slide channels of which mention has been made hereinabove. These projections and recesses already form part of the strip 2 from which the caseband 1 is obtained as may well be seen on FIGS. 1 and 2. To obtain the caseband from the strip 2 it is sufficient to provide opening 7 (intended to receive the movement) and to cut off the strip.

The explanations which have just been given show how easy it is to produce a caseband having a shape and cross-section which are relatively complex since one starts out with material in strip form already having the desired forms and cross-sections. This type of contoured strip is well known, for instance in the technology of architectural construction and is obtained in length at very favourable prices. It has however never been suggested for the manufacture of watchcases. One may thus obtain casebands which are very inexpensive since one avoids a large number of machining or subsequent re-touching operations. It will likewise be noted that the caseband thus obtained is in one piece only, thus avoiding attachment pieces which must inevitably be fastened to the caseband by fastening means such as screws. The caseband in a single piece likewise enables obtaining a rigid product which runs little risk of falling apart.

There is no intention here of describing in detail how the crystal and the back cover may be fastened to the proposed caseband. To this end the reader may refer to Swiss patent document CH-A-632 886 which explains how the crystal may be mounted in a water-tight fashion between two slide channels facing one another. Likewise, the fastening of the bracelet strands has not been described since it is well known. Each of these strands includes a slide channel which may be threaded over the beads 4 shown on FIG. 1.

Figure 2:
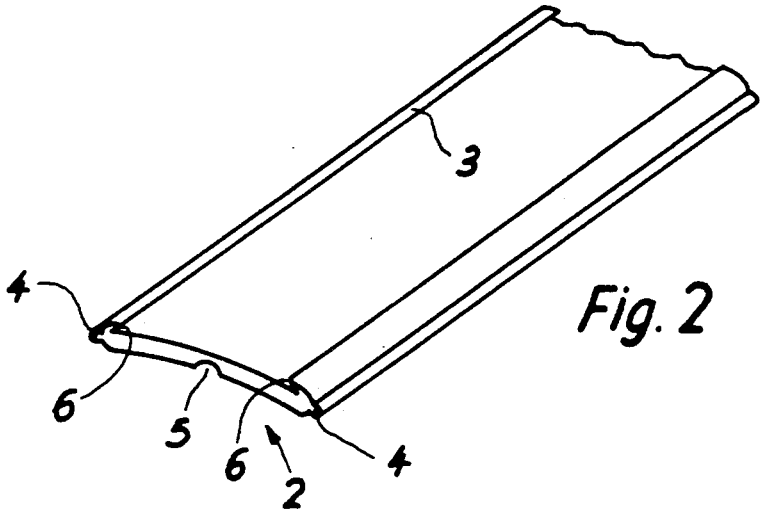
FIG. 2 shows a contoured strip from which is obtained the caseband of FIG. 1.

FIGS. 1 and 2 show further that the caseband comes out of a portion of the contoured strip 2 exhibiting arching substantially perpendicular to the longitudinal direction of the strip. In this case arching exists already in the contour itself. It is obviously clear that this arching could be eliminated and thus the caseband would be flat. Without there being the necessity of illustrating it, the strip 2 could also be mechanically arched parallel to the longitudinal direction of the strip. In the same manner, the strip could at the same time exhibit both archings which would give to the caseband the form of a cap. Finally one or the other of these archings or the two together may be obtained after the caseband has been separated from the strip.

Figure 3:
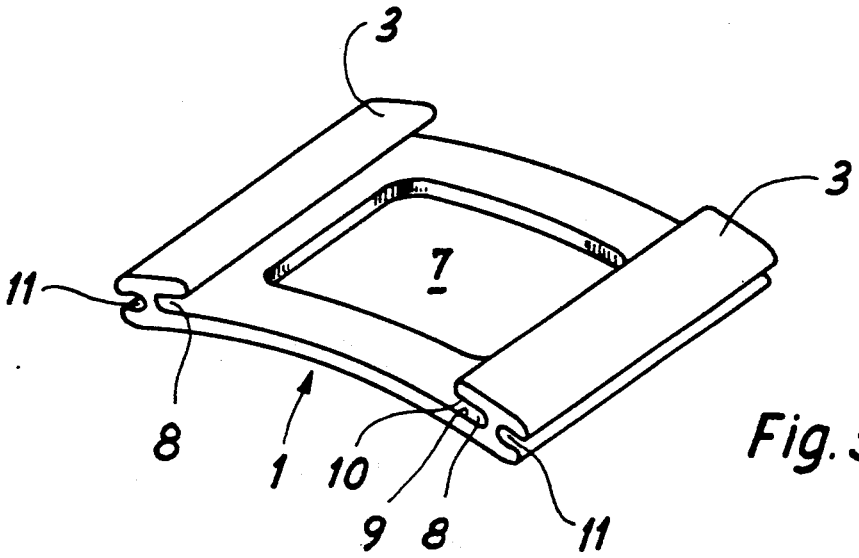
FIGS. 3 and 4 show variants of the casebands obtained from the embodiment shown on FIG. 1.

FIG. 3 shows a caseband having a form very similar to that described in FIG. 1. Here however the crystal is introduced between two slide channels 8, each of which has parallel faces 9 and 10. The method of fastening the crystal is described for instance in the Swiss patent document CH-A-643 425. As in the case of FIG. 1, the slide channels 8 come from projecting structures 3. It is the same in respect of the elongated recesses 11 which serve as fastening means to the strands of a bracelet, the end of each of these strands then exhibiting beads which are threaded into the recesses 11.

Figure 4:
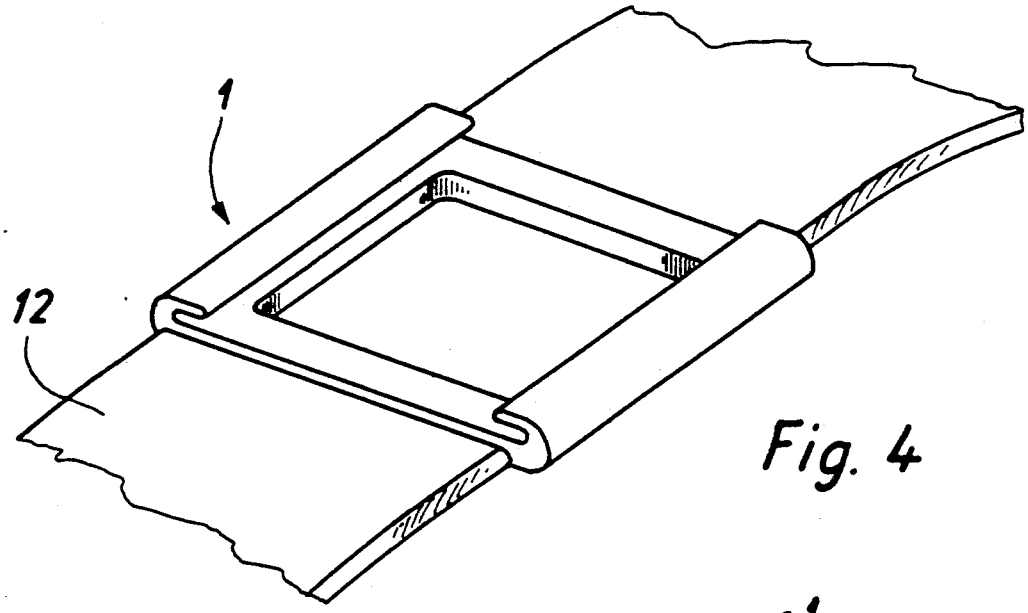

FIGS. 1 and 3 show that the axis 3 o'clock to 9 o'clock of the watch coincides with the longitudinal direction of the contour. FIG. 4 which is another variant of caseband shows that it is the axis 12 o'clock to 6 o'clock of the watch which coincides with the longitudinal direction of the contour, the bracelet 12 coming out of the caseband in the sense of this contour.

Figure 5:
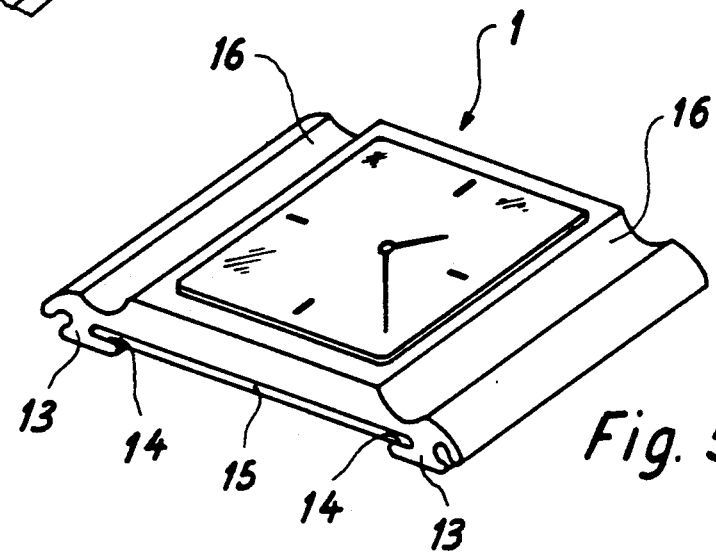
FIG. 5 shows a caseband for a watchcase according to a second embodiment of the invention, in which the contoured strip is profiled to receive at the same time a back cover and a bracelet as well as decorative patterns.

FIG. 5 shows a second embodiment of the invention. Here one is concerned with a watch in which is mounted the movement and the crystal. Caseband 1 is likewise provided from a portion of a contoured strip wherein the profile in relief coming from the strip includes projections 13 defining slide channels 14 facing one another into which slide channels the back cover 15 is introduced. The bracelet strands which are not shown are attached to the caseband in the same manner as that described having reference to FIG. 3. FIG. 5 shows in addition structures in the form of recesses 16 which define purely decorative patterns.

Figure 6:
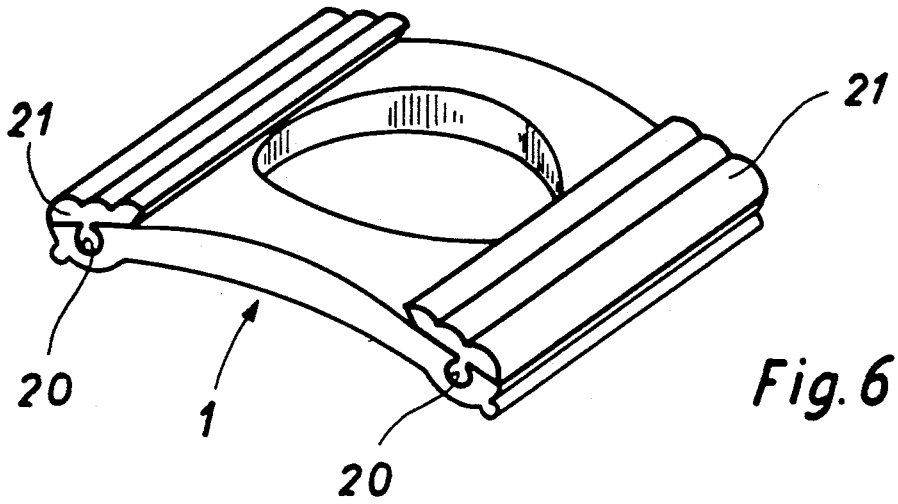
FIGS. 6, 7 and 8 each show a caseband for a watchcase according to a third embodiment of the invention in which the contoured strip is profiled to receive inserts.
Figure 7:
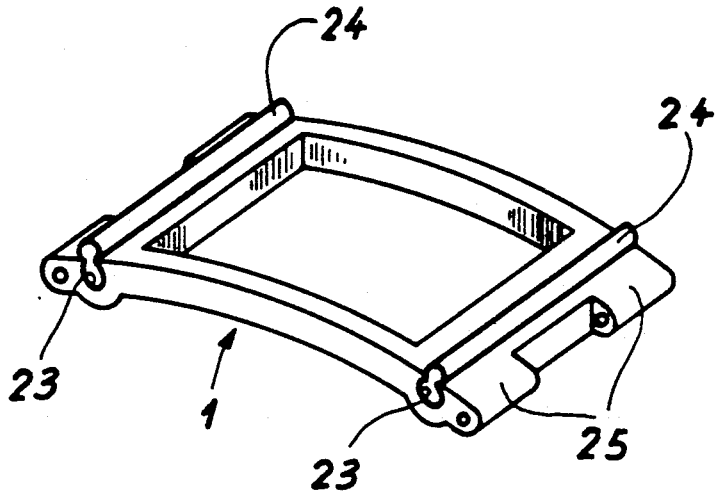
Figure 8:
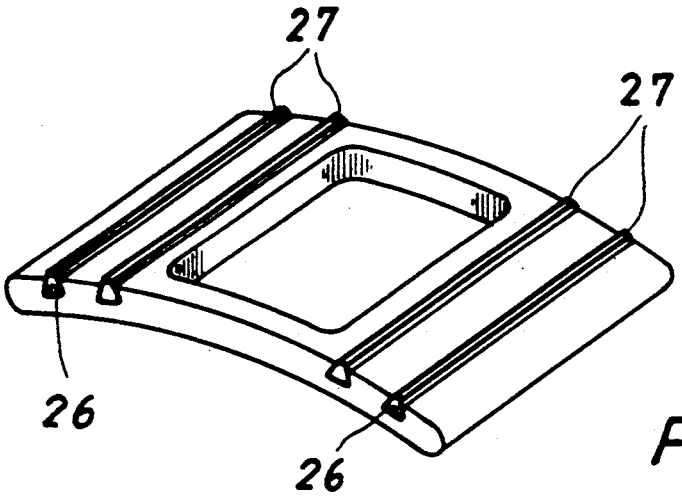

FIGS. 6, 7 and 8 show a caseband for a watchcase according to a third embodiment of the invention in which the strip is profiled in order to receive inserts.

FIG. 6 shows a watch case including a caseband 1 removed from a portion of a contoured strip, said caseband comprising a profile in relief including recesses 20 in which are introduced inserts 21 which serve as means for fastening a crystal (not shown) to the caseband 1. It is seen that in this construction the crystal is squeezed between caseband 1 and inserts 21. It is clear that the inserts themselves could likewise be provided from a contoured strip.

FIGS. 7 and 8 each show a caseband 1 provided with purely decorative patterns. FIG. 7 shows a caseband 1 of which the recesses 23 originating in the contoured strip serve as means for fastening rounded off strips 24. It will be noted that in this variant the fastening means for the bracelet comprises lugs 25 which may be obtained following the other operations by grinding. The decorative strips 24 may be made of gold.

FIG. 8 is distinguished from FIG. 7 by the fact that the recesses 26 in which the decorative strips 27 are inserted have a triangular form.

Figure 9:
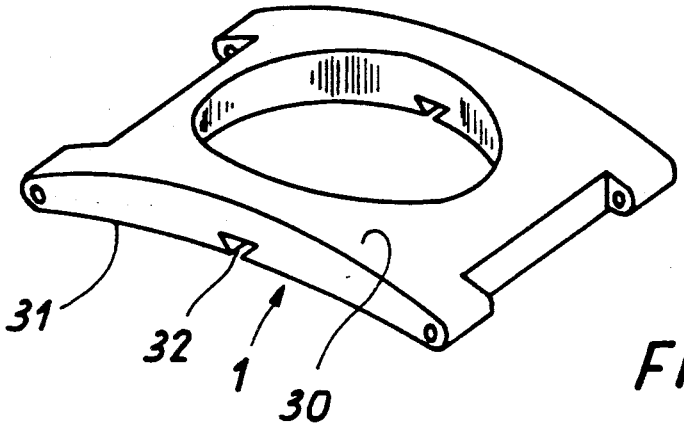
FIG. 9 shows a caseband for a watchcase according to a fourth embodiment in which the contour is profiled simply by the fact that the top and bottom faces of the caseband are not parallel and FIG. 10 shows a method of manufacture of the caseband of FIG. 1 from a contoured strip.

FIG. 9 finally shows a fourth embodiment of the invention in its most simple form. Here the caseband 1 comes from a contoured strip, the elongated profile in relief of which, in the longitudinal direction of the strip is obtained by bestowing on the upper face 30 of the caseband a radius of curvature smaller than the radius of curvature of the lower face 31 of said caseband. As a variant the lower face could be planar. FIG. 9 likewise shows that the caseband is provided with a profile in recessed relief 32 which may give an indication of origin. On this subject it will be remarked that groove 32 such as shown may not be obtained other than from a contoured strip and that its presence gives witness that the caseband has been manufactured according to the present invention.

It is self-evident that the idea of a contoured strip is coupled with the idea of manufacture of this strip which is obtained for instance by extrusion, drawing or rolling. Such a strip may be made of the most diverse materials running from plastics to ceramic and in considering for instance aluminum, brass, steel and precious metals.

Figure 10:
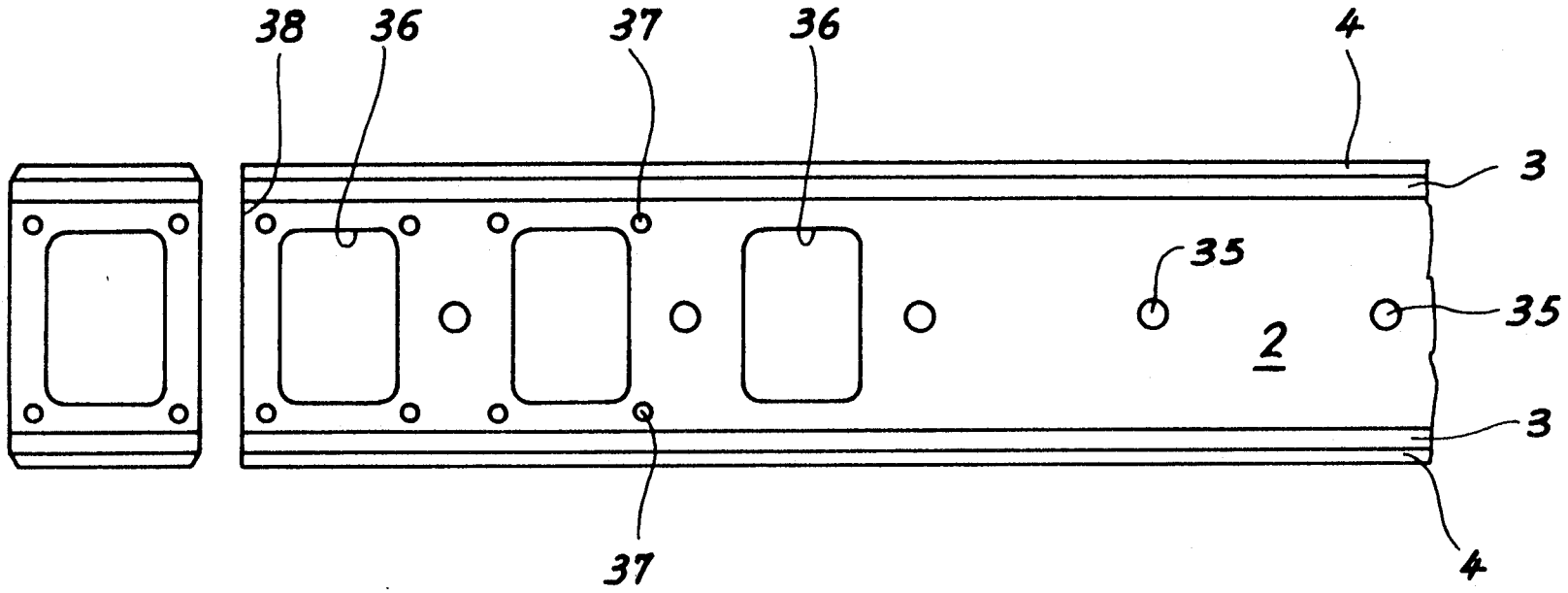

FIG. 10 shows briefly the manufacturing stages of the caseband in accordance with the invention. One provides a contoured strip 2 such as is shown in perspective on FIG. 1. The strip 2 of FIG. 10 is seen from above, on the side of the watch crystal. Herein there are apparent the fixing means 4 for the bracelet and the projections 3 between which the crystal will be squeezed.

One begins by piercing pilot holes 35 employed for transport and guidance of the strip. Next one provides an opening 36 in which the movement will be housed then the holes 37 which serve for fastening the back cover. Further operations may be executed at this stage, as for instance bevels, bearing surfaces, housings, etc., all such machine operations being brought about prior to separating the caseband from the strip. Next one detaches the caseband from the strip by a cut off operation shown on the drawing by line 38. If necessary thereafter the machining of the caseband will be terminated.

What I claim is:

1. A method of making a wristwatch caseband, said method comprising the steps of:

forming a contoured strip exhibiting a profile in relief, said profile in relief comprising repeating segments extending in the longitudinal direction of said strip;

shaping said strip while leaving said profile in relief unchanged in at least one zone of each of said repeating segments, said shaping including at least the forming of at least one recess in said strip within each of said repeating segments configured to receive a wristwatch movement, whereby each of said segments comprises a wristwatch caseband; and, separating said repeating segments subsequent to said shaping, whereby said profile in relief is present in each of said casebands after said separation.

2. A method as claimed in claim 1 wherein the step of shaping said contoured strip comprises forming two parallel recesses in each of said segments for retaining a crystal.

3. A method as claimed in claim 1, wherein the step of shaping said contoured strip comprising forming two elongated beads on each of said segments for attaching half-bracelets to each segment.

4. A method as claimed in claim 1 wherein the step of shaping said contoured strip comprises forming two elongated recesses in each of said segments for attaching strands of a bracelet thereto.

5. A method as claimed in claim 1 wherein the step of forming said contoured strip comprises arching said strip perpendicular to its longitudinal direction.

6. A method as claimed in claim 1 wherein the step of forming said contoured strip comprises arching said strip parallel to its longitudinal direction.

7. A method as claimed in claim wherein the step of shaping said contoured strip comprises forming two parallel recesses in each of said segments extending in the longitudinal direction of the strip, said parallel recesses being adapted to retain a segment on a watch band.

8. A method as claimed in claim 1 wherein the step of forming said contoured strip comprises shaping a material by one of the groups of methods comprising extruding, drawing and rolling.

* * * * *